US005484360A

United States Patent [19]

Haber et al.

[11] Patent Number: 5,484,360

[45] Date of Patent: Jan. 16, 1996

[54] CONTINUOUS ROPE CLIMB EXERCISER

[76] Inventors: Terry M. Haber, 25011 Castlewood, El Toro, Calif. 92630; William H. Smedley, 33285 Blanche Dr., Lake Elsinore, Calif. 92330; Clark B. Foster, 23631 Wakefield Ct., Laguna Niguel, Calif. 92677

[21] Appl. No.: 264,709

[22] Filed: Jun. 23, 1994

[51] Int. Cl.[6] ..... A63B 7/04

[52] U.S. Cl. ..... 482/37; 482/7

[58] Field of Search ..... 482/34, 37, 51, 482/148, 5–7

[56] References Cited

U.S. PATENT DOCUMENTS 3,782,718 1/1974 Saylor ..... 482/37

4,512,570 4/1985 Tardival ..... 482/37

5,076,574 12/1991 Johnson ..... 482/37

*Primary Examiner*—Stephen R. Crow

*Attorney, Agent, or Firm*—Hawes & Fischer

[57] ABSTRACT

The exercise device provides a continuous loop of rope which is slowly fed downwardly from the greater extent of a davit-like housing, and through an open space in which the climber will perform the climbing exercise. The rope then continues through a friction pulley configuration driven by a variable speed gear motor, and then upwardly through the davit-like housing to again travel through the open space. The speed of the motor can be controlled in a feed-forward manner where the user sets the speed, as in one training configuration where the speed of the rope is to be exceeded by the climber, or where the progress of the climber movement may be determined by sensors which determine how close to a pre-determined height the climber has progressed.

8 Claims, 3 Drawing Sheets

CONTINUOUS ROPE CLIMB EXERCISER

FIELD OF THE INVENTION

The present invention relates to the field of exercise equipment. More specifically, the present invention relates to a self-contained, safe and automated system for rope climbing which enables the tracking of progress.

BACKGROUND OF THE INVENTION

Rope climbing has long been a staple of fitness exercise. Rope climbing fitness is useful not only as an exercise to stimulate the cardiovascular system and upper body muscles, but rope climbing fitness is also useful to enable humans to maneuver upwardly over obstacles and in mountain climbing.

One of the major disadvantages in rope climbing, as with other types of exercise, is the safety factor. In order to improve significantly and at a more rapid pace, the capacity of the individual performing the exercise must be pushed to the limit. In sports like running, skipping rope, etc. when the participant becomes tired it is easy to simply cease the activity and immediately sit or lie down. As a result, the athlete can push himself to the point of exhaustion during each exercise period.

With rope climbing, and some other forms of exercise, the performance of the exercise to the point of exhaustion is extremely dangerous and in some cases fatal. The typical gymnasium rope climb consists of a fifteen to twenty foot rope which is attached to the rafters over a hard wood floor. The climber will typically climb as high as possible, with the object to touch the swivel connection at the top before coming down.

If the climber becomes exhausted while high off the floor, several negative possibilities can result. If the grip is completely lost, the climber can fall to the floor causing injury or death. If the grip cannot be maintained, the tendency is to wrap the rope through the legs or around the arm and slide down. Since most ropes are usually of rough material, including hemp or the like, a severe abrasion can occur.

In the case of a handicapped climber, the danger factor is further enhanced. Paraplegic climbers do not have the use of their legs to form a brake should they become exhausted while climbing. The failure of the climbing grip, or even a momentary hand entanglement would result in a straight fall.

As a result of both of the above factors, most rope climbers will not tend to push themselves to the point of exhaustion, and will approach the rope climbing activity conservatively. While this approach is practical given the surrounding circumstances, it does not permit the enhanced physical conditioning which is possible for the athlete, or which is extremely necessary to the soldier or rescue worker.

Further, one who is trained in a gymnasium configuration will only climb about ten to fifteen feet at one time. Repetition, by climbing up and down the rope will lead to increased conditioning, but not the type of conditioning that a longer rope would provide. On the other hand, a longer rope would exacerbate the danger factor, particularly where the object is to reach the top, and where a climber might push his endurance to reach such a goal, and become exhausted at a higher elevation.

Especially in the case of the soldier or rescue worker, a conditioning which teaches the body to climb for only ten or fifteen feet before a rest will leave the climber unprepared for longer lengths of sustained climbs.

Another problem with rope climbing in the gymnasium setting is the necessity for assistance at the lower end of the rope to hold it steady. Where the rope sways or swings, it can upset the natural pace of climbing of the rope. Since the purpose of gymnasium rope climbing is conditioning, the swaying of the rope will add an undesired effect which detracts from the goal of conditioning. Although actual conditions of climbing, battle, or rescue will need to be included in a soldier or rescuer's regimen, the swaying of a vertical rope during fitness training is usually not a condition which is desired to be constantly present.

In consideration of the above factors and limitations, what is needed is a device and method which will enable rope climbing in a safe and controlled manner. The method should encourage the climber to push his climbing skills to the limit without the fear of falling or rope burns and abrasions. The device should enable a longer continuous climb without the need to climb and re-climb a finite height of rope. The needed device and method should readily lend itself to tracking and measuring the progress and endurance of the climber. The needed device should not be subject to the sway and swing which would be encountered in the gymnasium setting and especially at the lower end of a long rope.

SUMMARY OF THE INVENTION

The rope exercise device and method of the present invention encompasses both an apparatus and method enabling a climber to steadily climb any distance, in a safe manner, and on a stable rope not subject to sway at its bottom end. The exercise device provides a continuous loop of rope which is slowly fed downwardly from the greater extent of a davit-like housing, and through an open space in which the climber will perform the climbing exercise. The rope then continues through a friction pulley configuration driven by a variable speed gear motor, and then upwardly through the davit-like housing to again travel through the open space.

The speed of the motor can be controlled in a feedforward manner where the user sets the speed, as in one training configuration where the speed of the rope is to be exceeded by the climber. The progress of the climber's progress may be determined by sensors which determine how close to a pre-determined height the climber has progressed. This will enable the climber to climber to begin at a higher rate of climb and push himself to the limits as his climb begins to slow.

Other climbing parameters can be set including distance climbed, speed of the climb, total time of the climb, energy expended in the climb (by also measuring the weight of the climber) and so forth. Because the overall height of the device of the present invention can be limited to between ten and fifteen feet, and because the device can be programmed to not allow the climber to vertically progress beyond a pre-determined height, the distance the climber reaches above the base is limited, and in the latter case controlled.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
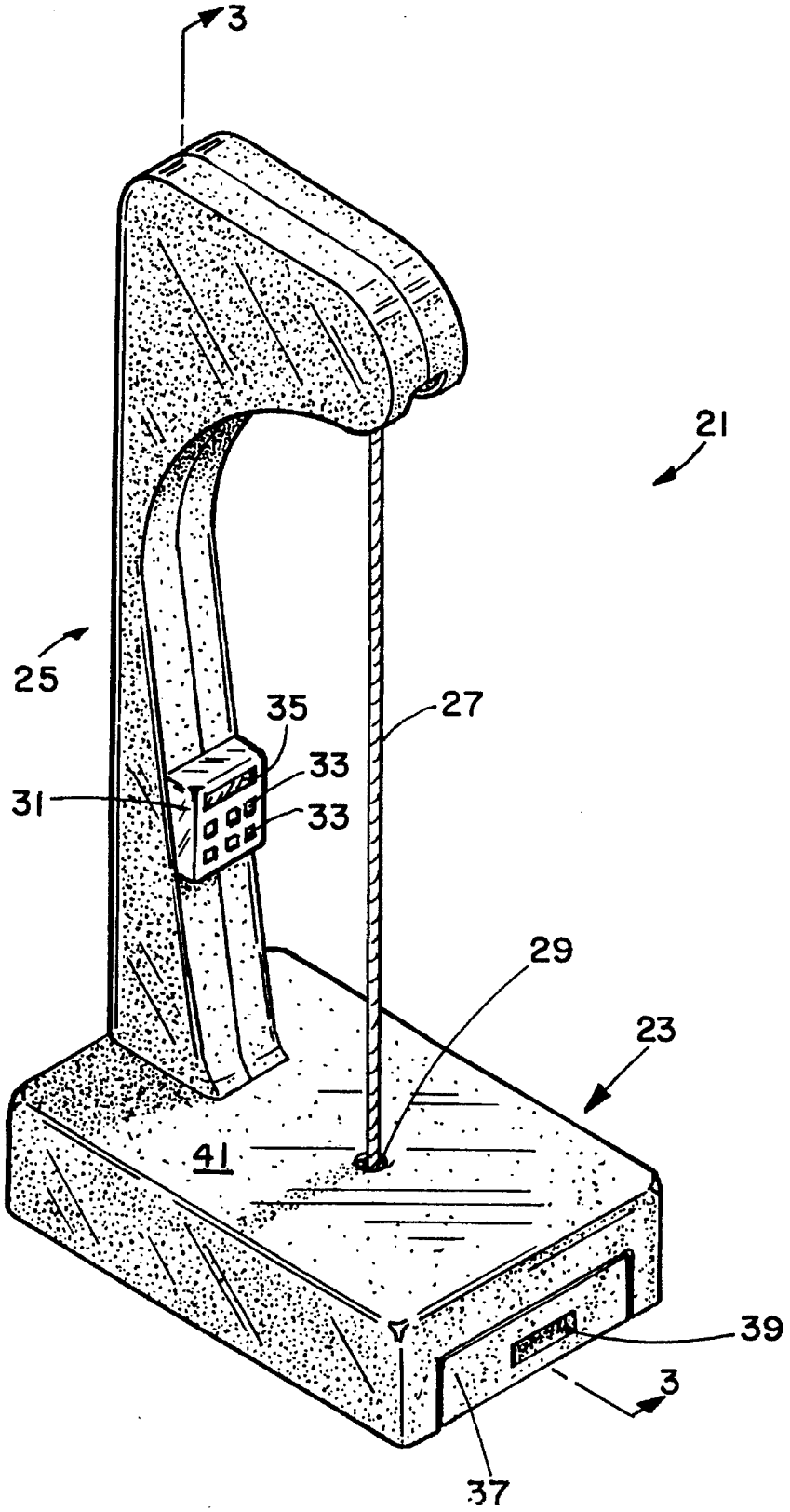
FIG. 1 is a perspective view of the rope climbing device of the present invention taken from the front and illustrating the davit shape, base, controls, and exposed length of rope for climbing.

The description and operation of the invention will be best described with reference to FIG. 1. FIG. 1 illustrates the rope climbing device 21 of the present invention whose overall structure includes a base 23 which supports a davit structure 25. A rope 27 is shown extending from the upper and outermost portion of the davit structure 25 and into an aperture 29 in the base 23.

The davit structure 25 supports a set of controls 31 including buttons 33 and display 35. An outwardly displaceable step 37 having a grasp 39 is shown at the front of the base 23. The step 37 is extendable to provide easy, step-up access to the rope climbing device 21.

The controls 31 will include a timer, some method of determining how much rope 27 has been fed, possibly by integration of the product of time and speed to determine the total length of rope 27 which has been fed. Controls 31 will also include a smoothing function to insure that any speed up or slow down action is done smoothly and continuously, without sudden acceleration or deceleration.

The structure shown in FIG. 1 is expected to have a nominal height of from ten to fifteen feet. The height of the base 23 is expected to be from over one to one and a half feet high to two to two and a half feet high. The base 23 height is dictated by the mechanism inside, which will be discussed below. Thus, the height of the base would be served by having a step 37.

The top of the base 23 includes a flat surface 41. Although the device 21 is shown as being a stand-alone device, the mechanism hereafter described can be implemented in a variety of structures and settings. Further, the mechanism for moving the rope 27 can exist in a floor, behind a wall, or overhead. Thus, the flat surface 41 may exist not only on base 23, but in a variety of different settings.

Figure 2:
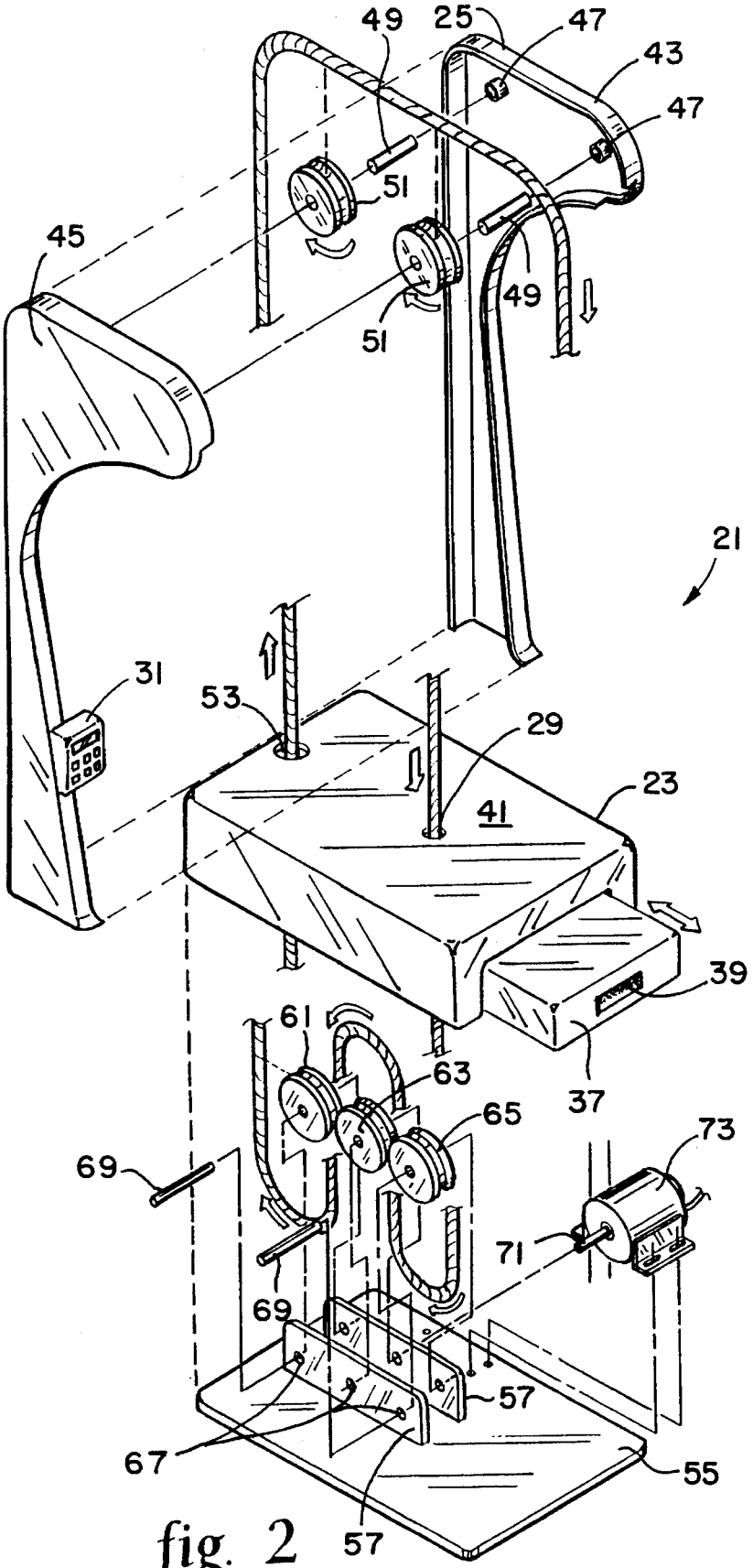
FIG. 2 is an exploded view of the rope climbing device of FIG. 1, and illustrating the inner structures and workings thereof.

Referring to FIG. 2, an exploded view of the rope climbing device 21 is illustrated. In this particular embodiment, the davit structure 25 is made of a complementary right half housing 43 and a left half housing 45. Referring to right half housing 43, a pair of axle support bosses 47 are seen. Shown in exploded lined view are a pair of axles 49, each associated with one of the axle support bosses 47. The axle support bosses 47 are shown associated with a pair of pulleys 51. Axle support bosses 47 also exist in the left half housing 45, but are not visible in FIG. 2.

The right and left half housings 43 and 45 will be joined together by any suitable means, such as bolting, etc, and the davit structure 25 will be attached to the base 23 in any suitable manner sufficient to support the forces exerted on rope 27. It is understood that alternative supports for the pulleys 51 may be provided, and that the pulleys 51 and rope 27 need not be as isolated from view as is shown in FIG. 2.

Base 23 is shown as having a rearwardly positioned aperture 53, into which rope 27 also extends. The rope 27 is illustrated in multiple sections to facilitate the expanded explosion of the component parts. Beneath the base 23, and fittable therein is a base platform 55 which will ideally be selected for its weight bearing capability. To the base platform 55 is attached two or more flanges 57 which will be used to support further pulleys. The flanges 57 will be sturdily attached to the base platform 55 and should be capable of withstanding significant force.

A set of three pulleys, 61, 63, and 65 are illustrated as being supported by the flanges 57, and including the flange apertures 67. A pair of axles 69 are shown which will engage pulleys 61 and 65. Pulleys 61 and 65 act as compression pulleys, to compress the rope 27 against the motor pulley, or middle pulley 63. The middle pulley 63, however will rotate with the drive shaft 71 of a gear motor 73. Gear motor 73 is solidly affixed to the base platform 55. The rope 27 is shown as threaded through the pulleys 61, 63, and 65 in a serpentine manner.

Such serpentine configuration increases the friction and angular contact of the rope 27 on the pulley 63. Pulley 63, through its connection to drive shaft 71 and gear motor 73 drives the rope on its circular path through the exercise device 21. The connection between the gear motor 73 to the rope 27 is a high torque, low speed connection. Ideally, the gear motor 73 will be reversible to allow not only a long ascent, but a long decent to be performed by a climber.

Pulley 63 may be fitted with a rubber insert to further enhance the friction between pulley 63 and rope 27. Flanges 67 can also carry adjustment mechanisms to control the tension on the rope 27. However, FIG. 2 illustrates another method of control, which is achieved by using pulleys with shallow rims and by placing the pulleys in such an extremely close position that the rope 27 is compressed between them. This configuration is further advantageous in that the middle pulley 63 is compressed evenly from both sides which eliminates forces normal to the drive shaft 71 which could warp the drive shaft 71, or damage the gear motor 73. All of the unbalanced force in the pulley configuration of FIG. 2 will lie with the axles 69 and the pulleys 61 and 65. Preferably all of the pulleys 61, 63, and 65 will have a frictional material on their slot areas to further enhance the ability of gear motor 73 to absolutely control the speed and direction of travel of the rope 27 through the rope climbing device 21.

Figure 3:
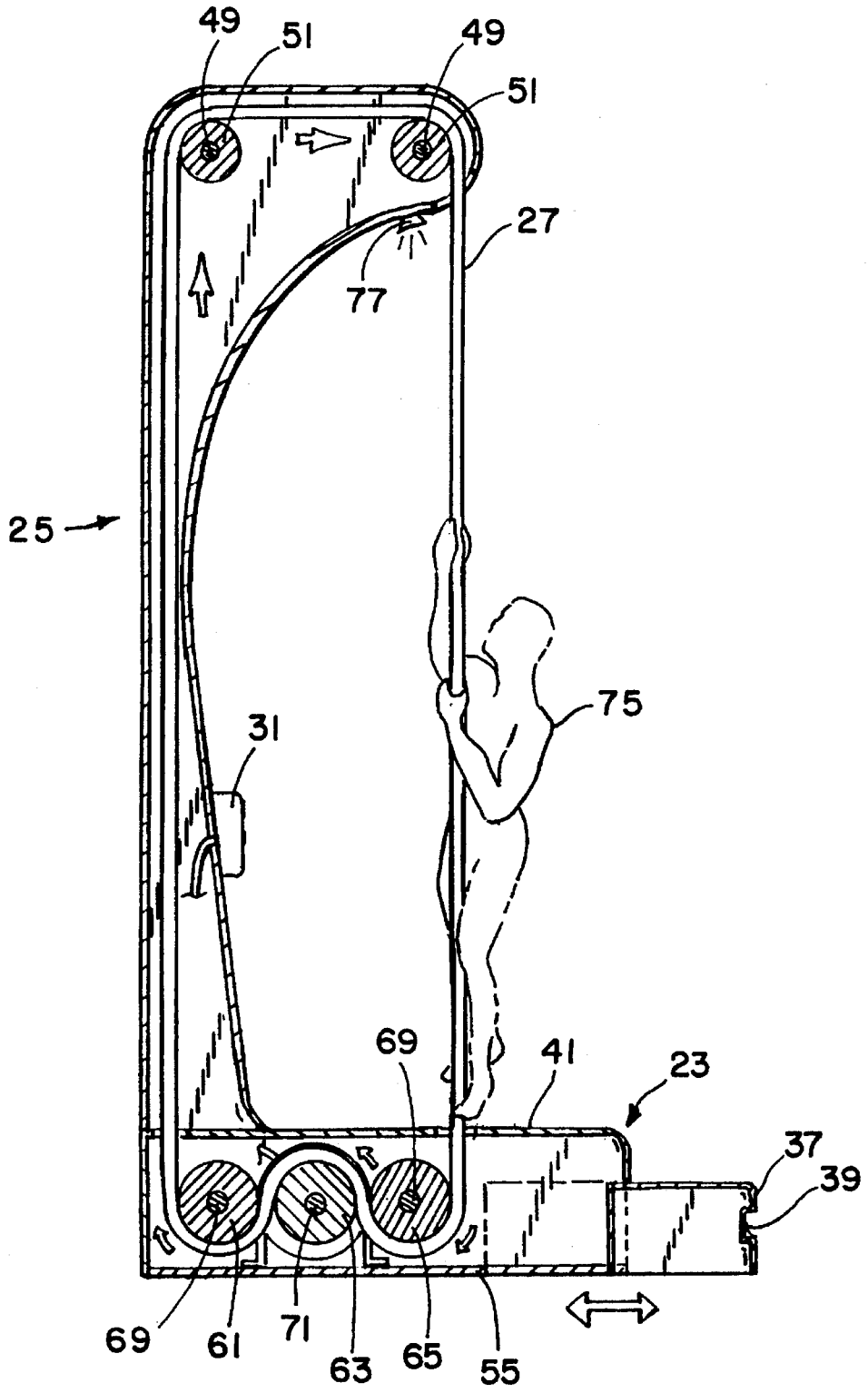
FIG. 3 is a side sectional view taken along line 3—3 of FIG. 1.

Referring to FIG. 3, a side sectional view taken along line 3—3 of FIG. 1 illustrates the direction of travel of the rope 27, and the approximate relative height of a climber 75. Also can be seen a proximity sensor 77 mounted on the davit structure 25 and pointed downwardly at the climber 75. In the configuration shown, when the sensor is in operation, the sensor will indicate to the electronics, preferably located within controls 31, the vertical progress of the climber 75, by noting his proximity with respect to the davit structure 25. Since climbing is a non-smooth vertical change process, adequate computational circuitry will preferably be employed within the controls 31 to smooth the speed of the gear motor 73.

In this manner, if the climber 75 approaches the proximity sensor 77 rapidly, the speed of the rope 27 will gradually increase, with the target set point configured to keep the climber at a constant distance from the top of the davit structure 25. As the climber 75 goes faster and above the distance set point, the rope 27 will be fed faster. As the climber 75 tires and begins to slow down, falling behind the distance set point, the rope 27 will be fed more slowly to give the climber 75 a chance to catch up. Of course, a burst of speed by the climber 75, or a slowing of the rate of climb will cause the gear motor 73 to change its rate of turn, at any time and in any direction, albeit smoothly. If the climber 75 stops, the rope will continue to slow down as the climber falls farther behind the distance set point. The controller 31 can be programmed to stop the feeding of the rope 27 once the climber 75 falls a certain distance behind the distance set point, or it can continue at a very low minimum speed until the climber touches down on the flat surface 41 of the base 23.

It is understood that although the invention has been described using a continuously looped rope 27, that a pair of rope spools (not shown) could be provided along with the appropriate controls to feed the rope 27 at a desired speed. Such a device would require a take-up reel for rope which has been fed past the climber 75, and the rope feed motor controls would need to be configured to ensure that the climber 75 would be safely protected. A rewind would be needed to reset the rope onto a let-out spool.

While the present invention has been described in terms of a rope climbing exercise machine and method, one skilled in the art will realize that the structure and techniques of the present invention can be applied to many appliances. The present invention may be applied in any situation where positive traction and control of a moving flexible member, such as a rope or conveyor is sought, and in which safety and controllability is a goal.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A rope climb exercise device comprising:

an overhanging davit structure;

a base, supporting said davit structure;

a length of rope fed vertically downwardly from said overhanging davit structure support; and a controlled speed feed mechanism connected to said rope and configured to control the feeding of said rope from said overhanging davit structure;

a base platform covered by said base;

at least one flange set supported by said base platform;

a pair of spaced apart axles supported by said flange set, each axle rotatably supporting an associated compression pulley; and a gear motor having a shaft supporting a drive pulley interposed between said compression pulleys.

2. The rope climb exercise device recited in claim 1 wherein said base is an enclosed structure and defining a first and second spaced apart aperture through which said rope extends into and out of said enclosed base.

3. The rope climb exercise device recited in claim 1 wherein said controlled speed feed mechanism is mounted in said base.

4. The rope climb exercise device recited in claim 1 wherein said controlled speed feed mechanism further comprises:

a variable speed motor mechanism, mechanically linked to said rope; and a speed controller controllably connected to said variable speed motor mechanism, which controls the speed of said variable speed motor mechanism.

5. The rope climb exercise device recited in claim 1 wherein said controlled speed feed mechanism is mounted in said base.

6. A rope climb exercise device comprising:

an overhanging structural support;

a length of rope fed vertically downwardly from said overhanging structural support; and a controlled speed feed mechanism connected to said rope and configured to control the feeding of said rope from said overhanging support and further comprising:

a variable speed motor mechanism, mechanically linked to said rope;

a speed controller controllably connected to said variable speed motor mechanism, which controls the speed of said variable speed motor mechanism; and a proximity sensor connected to said speed controller and directed toward a space adjacent said rope to enable control of the rate of feed of said rope based upon the position of a climber.

7. The rope climb exercise device recited in claim 3 wherein said speed controller is configured to integrate the product of time and speed to determine the total length of rope which has been fed.

8. The rope climb exercise device recited in claim 3 wherein said base is an enclosed structure and defining a first and second spaced apart aperture through which said rope extends into and out of said enclosed base.

* * * * *